US005747939A

United States Patent [19]

Kim et al.

[11] Patent Number: 5,747,939

[45] Date of Patent: May 5, 1998

[54] PLASMA DISPLAY PANEL WITH CONTROL RESISTANCE VALUES FOR RESTRICTING CURRENT FLOW INTO THE CATHODES

[75] Inventors: Dae-il Kim, Kyungki-do; Nac-koo Kim; Kyung-min Kim, both of Seoul; Dong-cheol Jeong, Kyungki-do, all of Rep. of Korea

[73] Assignee: Samsung Display Devices Co., Ltd., Kyungki-do, Rep. of Korea

[21] Appl. No.: 767,350

[22] Filed: Dec. 18, 1996

[30] Foreign Application Priority Data

Dec. 21, 1995 [KR] Rep. of Korea ..... 95-53509

[51] Int. Cl.[6] ..... H01J 17/34

[52] U.S. Cl. ..... 315/169.4; 313/584; 313/586

[58] Field of Search ..... 313/586, 587, 313/584, 590, 510; 315/52, 169.1, 167, 169.3, 169.4

[56] References Cited

U.S. PATENT DOCUMENTS

| | | | |
|---|---|---|---|
| 4,665,345 | 5/1987 | Shinoya et al. | 315/169.4 |
| 4,996,460 | 2/1991 | Kim et al. | 313/586 |
| 4,999,541 | 3/1991 | Kim et al. | 313/584 |
| 5,371,437 | 12/1994 | Amano | 315/169.1 |

OTHER PUBLICATIONS

"Formation of Current Leakage Paths at the Interface between Dielectrics in Intense Electric Fields in a Gas Discharge Device", S. Mikoshiba, S. Shinada, K. Kitagawa, Japanese Journal of Applied Physics, vol. 30, No. 1, Jan. 1991, pp. 146–151.

*Primary Examiner*—Robert Pascal
*Assistant Examiner*—David H. Vu
*Attorney, Agent, or Firm*—Christie, Parker & Hale,LLP

[57] ABSTRACT

A plasma display panel prevents mutual reaction between the cathode electrodes and resistance layers during the manufacturing process and reduces any decreasing of resistance values. Also, equal brightness on the entire surface of the screen and a high-resolution image is attained. And finally, the manufacturing process is made simple and there is optimization of the whole structure. Connect bars are inserted between the anodes and cathode electrodes in order to make equal, at every connecting discharge cell, the resistance values, and there is a reduction of contact resistance to such an extend that it can be discounted. Trigger electrodes and cathode bus lines, which emit auxiliary discharges, are formed parallel to each other on an identical plane. Branch electrodes that extend out from the trigger electrodes are arranged so as to extend out into the discharge cells.

7 Claims, 2 Drawing Sheets

PLASMA DISPLAY PANEL WITH CONTROL RESISTANCE VALUES FOR RESTRICTING CURRENT FLOW INTO THE CATHODES

FIELD OF THE INVENTION

The present invention relates to a plasma display panel (PDP), and more particularly, to an electrode structure of a direct current PDP which maintains equal resistance values for restricting current induced into a cathode in the whole surface of the screen.

BACKGROUND OF THE INVENTION

In general, PDPs are displays which seal up Ar and Ne gas between two glass plates; have formed in this space, anodes and cathodes in an X-Y matrix; and generate a neon glow by using the discharge of electricity that occurs when voltage is increased.

Because the PDPs are self-emission type that brightly display information on screens, they are applicable to workstations, office automation instruments, lap-top PCs and color TVs of the kind hung on walls, etc.

The above mentioned PDPs are divided, depending on how electricity is discharged, into direct-current and alternating-current PDPs. Direct-current PDPs include Planar Pulse Memory(PPM) PDPs which are made and studied by the NHK research institute.

Prior direct-current PDPs have a short life which proves problematic.

The basic origin of the above problem is the shock to the cathode by speeded-up positive ion electrons brought about by ion sputtering while electricity is being applied. As a result, the cathode is damaged which negatively affects the longevity of PDPs.

To solve the above mentioned problem, technology is recently being used which connects resistance to each discharge cell that cross the anode and cathode, and by restricting the flow of the electric current the cathode is protected from ion sputtering.

The cathode electrode is generally made of Ni while the resistance layer is made of $RuO_2$.

However, in the prior PDP, there are a vast number of discharge cells. As a result, the sticking of resistances to each discharge cell is not only a difficult process, but it requires high precision.

Furthermore, in order to balance the brightness of the screen, the resistance values for the discharge cells must be kept equal. But the above mentioned cathode electrode and resistance layer have contact resistance problems.

More in detail, Ni or Ba used to form the cathode electrode and the $RuO_2$ used to form the resistance layer give rise to mutual reaction in the manufacturing process which results in the inability to control discharge cell resistance values. Such a plasma display panel is disclosed in Japanese journal of Applied Physics Vol. 30, No. 1, January, 1991, pp.146–151.

Also, matters are further complicated in the manufacturing of the PDPs in that the trigger electrode, dielectric layer and cathode bus line overlap one another at each level which makes for a most difficult production process.

Such a plasma display panel is disclosed in U.S. Pat. Nos. 4,999,541, 4,996,460, 4,665,345.

SUMMARY OF THE INVENTION

Considering these problems of prior art, the present invention has the following two goals: 1) to make equal, on the whole surface of the screen, resistance values that restrict the electrical current passing through the cathode and; 2) to offer a plasma display panel of changed structure so that manufacture is easy.

Accordingly, to achieve the above described goals, the present invention provides a plasma display panel with the following structure.

This plasma display panel comprises opposing anodes and cathode bus lines formed respectively to two plates to be opposed each other in an X-Y matrix and a lattice wall which is disposed between the plates of glass to prevent crosstalk between pixels.

Cathode bus lines and cathode electrodes maintain resistance layers between them.

Preferably, in order to maintain equal resistance values at each discharge cell that is formed by intersecting the anodes and cathode electrodes, the present invention brings with it the distinct feature of, by interposing a connect bar in the space between the cathode electrode and resistance layer, lowering the contact resistance to a level that can be ignored.

Also, the present invention has the feature of generating auxiliary discharge by forming the trigger electrode and cathode bus line parallel to and flush with each other and, also, auxiliary discharge is generated by having the protruding branch electrodes of the trigger electrode extended and arranged to the inside of each discharge cell.

BRIEF DESCRIPTION OF THE DRAWINGS

The accompanying drawings, which are incorporated in and constitute a part of the specification, illustrate an embodiment of the invention, and, together with the description, serve to explain the principles of the invention.

DETAILED DESCRIPTION OF PREFERRED EMBODIMENT

A preferred embodiment of the present invention will now be described in detail with reference to the accompanying drawings.

Figure 1:
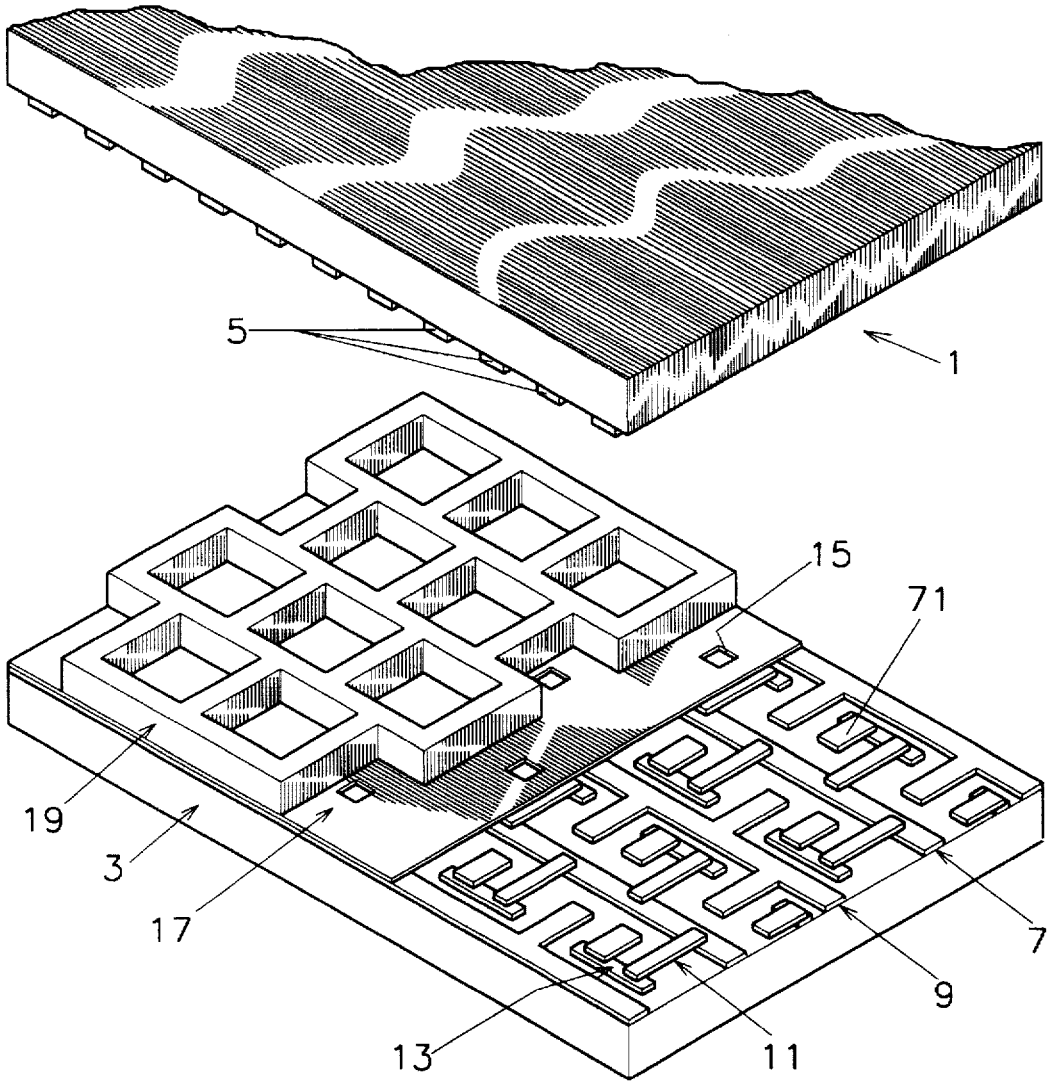
FIG. 1 is a partly cutaway perspective view illustrating a plasma display panel according to a preferred embodiment of the present invention.

FIG. 1 shows a plasma display panel in accordance with a preferred embodiment of the present invention. The reference numerals 1 and 3 respectively indicate front and rear side glass plates.

In the lower end of the front side glass plate 1, R,G,B phosphor pixels and anodes 5 are formed in the widely-known delta arrangement for the realization of color.

In the upper portion of the rear side glass plate 3, cathode bus lines 7 are formed opposing the anodes 5. The anodes 5 and the cathode bus lines 7 are crossed in an X-Y matrix.

Also, a resistance layer 11, connect bars 13 and cathode electrodes 71 are connected to the cathode bus lines 7.

In every space between the bus lines 7, trigger electrodes 9 are arranged in parallel lines to each other and the bus lines 7.

The trigger electrodes 9 efficiently create and use charged particles. As described above, the trigger electrodes 9 are arranged on the same plane as that of the cathode bus lines 7 while the conventional trigger electrodes are separated on a different level from the cathode bus lines by interposing a dielectric layer there-between.

A dielectric layer 17, provided with through holes 15, is formed on the cathode bus lines 7 and the trigger electrodes 9. And on the dielectric layer 17 lattice walls 19 are disposed forming pixels which divide discharge cells and prevent crosstalk between the pixels.

Figure 2:
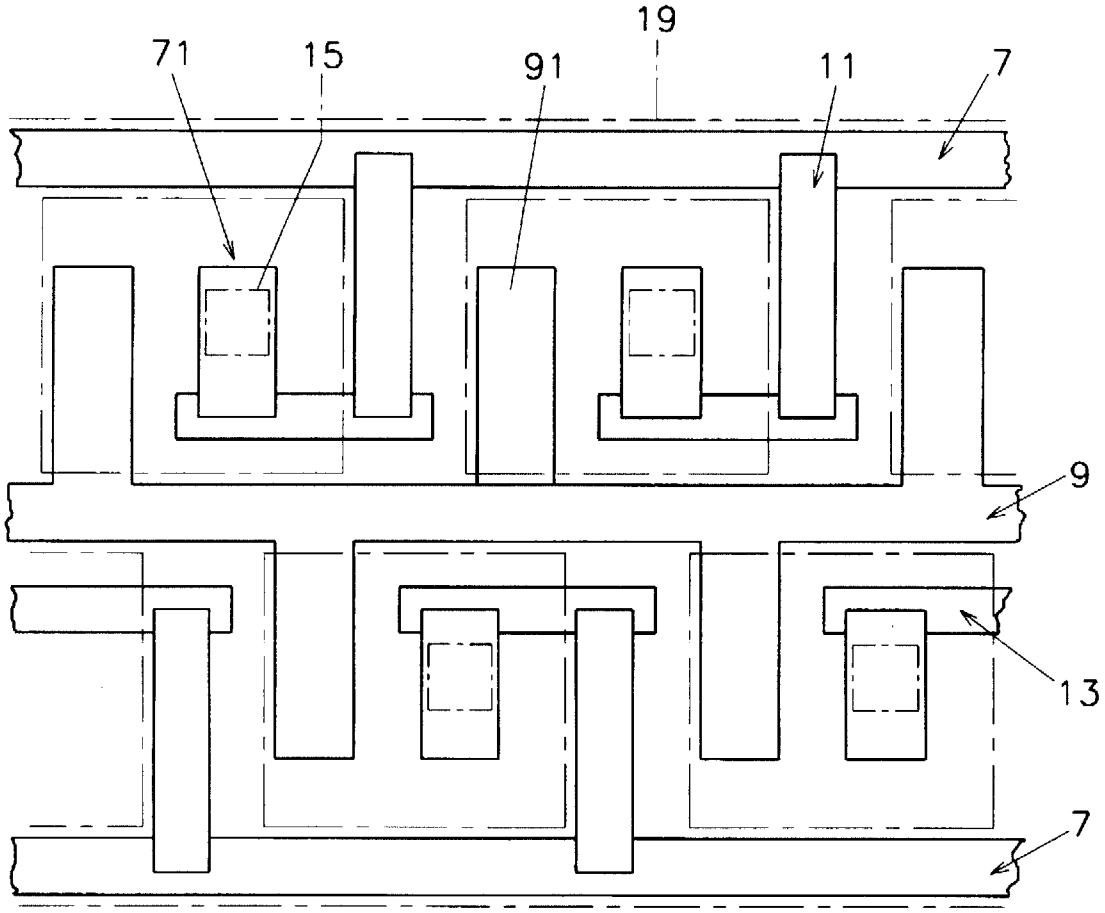
FIG. 2 is a plane view of a rear side of a glass plate illustrated in FIG. 1.

The structure of the above mentioned rear glass plate, which constitutes the present invention's plasma display panel, is illustrated in detail in FIG. 2.

As illustrated, the cathode bus lines 7 are coupled to the resistance layers 11 to maintain equal resistance values throughout the pixels, or resistance cells, of which hundreds-of-thousands can be found in the anodes 5 and cathode electrodes 71.

The resistance layers 11, as is well known, are made from a material with the chemical composition of $RuO_2$.

In the present invention, special connect bars 13 are inserted in the space between resistance layers 11 and cathode electrodes 71 to prevent contact resistance therebetween.

The connect bars 13 are made of a paste whose principle element is, for example, Ag. This material is used so as to not cause a reaction with the $RuO_2$ of which the resistance layers 11 are made.

Furthermore, the cathode electrodes 71 are made from, for example, Ni which is a material that will not cause contact resistance with the connect bars 13.

Accordingly, as a result of the present invention's connect bars 13, the decrease in resistance values that can occur at every resistance cell is reduced to such a low level that it can be ignored.

Also, because of the reduction in any type of decrease in resistance, the brightness of the display panel's screen is kept uniform and a beautiful, high-resolution image is projected.

As can be seen in FIG. 2, the trigger electrodes 9 of the present invention are not only formed in a parallel fashion and on the same plane with the cathode bus lines 7, but they include branch electrodes 91 that extend into each discharge cell.

Unlike prior art which have a complex layer structure, the trigger electrodes 9 of the present invention, because they are formed on the same plane with the cathode bus lines 7, make manufacture easy and make the whole structure of the display panel compact.

As can be ascertained by the drawings, the trigger electrodes 9 are organized in lines. The present invention is not limited by this organization. That is, some of the trigger electrodes 9 can be electrically connected to each other if there is need for plurality of trigger electrodes to be simultaneously driven.

While this invention has been described in connection with what is presently considered to be the most practical and preferred embodiments, it is to be understood that the invention is not limited to the disclosed embodiment, but, on the contrary, it is intended to cover various modifications and equivalent arrangements included within the spirit and scope of the appended claims.

What is claimed is:

1. A plasma display panel, comprising:

two substantially parallel plates;

a plurality of bus lines disposed on one of the plates, each of the bus lines having a plurality of electrodes connected thereto;

a resistance layer connected between each electrode and its respective bus line;

lattice walls positioned on the bus lines to prevent crosstalk between discharge cells;

a plurality of trigger electrodes disposed in substantially the same plane as the bus lines, at least one of the trigger electrodes being formed between a pair of the bus lines; and a dielectric layer disposed between said lattice walls and said trigger electrodes.

2. A plasma display panel of claim 1 further comprising connect bars for electrically connecting the electrodes to their respective resistance layers, said connect bars being disposed in substantially the same plane as the trigger electrodes and the bus lines.

3. A plasma display panel of claim 1 wherein said trigger electrodes are exposed to the discharge cells.

4. A plasma display panel of claim 2 wherein said connect bars comprise a paste having Ag.

5. A plasma display panel of claim 1 further comprising a plurality of anodes disposed on the other plate and wherein said dielectric layer has through holes such that said trigger electrodes and said bus lines cause the discharge of electricity between the anodes and the electrodes.

6. A plasma display panel of claim 1 wherein said trigger electrodes and said bus lines are alternately formed.

7. A plasma display panel of claim 1 wherein each of said trigger electrodes comprises a plurality of branch electrodes, each of the branch electrodes extending into a different one of the discharge cells, said branch electrodes being disposed in substantially the same plane as that of the trigger electrodes.

* * * * *